US010937617B2

(12) United States Patent
Minowa et al.

(10) Patent No.: US 10,937,617 B2
(45) Date of Patent: Mar. 2, 2021

(54) RELAY

(71) Applicant: Omron Corporation, Kyoto (JP)

(72) Inventors: Ryota Minowa, Kumamoto (JP); Hiroyuki Iwasaka, Kumamoto (JP); Shingo Mori, Kumamoto (JP)

(73) Assignee: Omron Corporation, Kyoto (JP)

( * ) Notice: Subject to any disclaimer, the term of this patent is extended or adjusted under 35 U.S.C. 154(b) by 96 days.

(21) Appl. No.: 16/282,546

(22) Filed: Feb. 22, 2019

(65) Prior Publication Data

US 2019/0304724 A1 Oct. 3, 2019

(30) Foreign Application Priority Data

Mar. 30, 2018 (JP) ..... JP2018-068870

(51) Int. Cl.

| | |
|---|---|
| ***H01H 67/02*** | (2006.01) |
| ***H01H 50/14*** | (2006.01) |
| ***H01H 50/12*** | (2006.01) |
| ***H01H 50/36*** | (2006.01) |
| ***H01H 50/02*** | (2006.01) |
| ***H01H 50/42*** | (2006.01) |
| *H01H 50/54* | (2006.01) |

(52) U.S. Cl.

CPC ..... *H01H 50/14* (2013.01); *H01H 50/02* (2013.01); *H01H 50/12* (2013.01); *H01H 50/36* (2013.01); *H01H 50/42* (2013.01); *H01H 50/546* (2013.01); *H01H 2050/362* (2013.01)

(58) Field of Classification Search

CPC ..... H01H 50/42; H01H 50/14; H01H 50/02

USPC ..... 335/195, 16, 147, 126, 131

See application file for complete search history.

(56) References Cited

U.S. PATENT DOCUMENTS 4,467,301 A * 8/1984 Goodrich ..... H01H 1/54 335/195

6,700,466 B1 3/2004 Yamamoto et al.

(Continued)

FOREIGN PATENT DOCUMENTS

CN 1327604 A 12/2001

CN 104704594 A 6/2015

(Continued)

OTHER PUBLICATIONS

Office Action issued in Chinese Application No. 201910109749.2; dated Oct. 19, 2020 (13 pages).

*Primary Examiner* — Alexander Talpalatski

(74) *Attorney, Agent, or Firm* — Osha Bergman Watanabe & Burton LLP

(57) ABSTRACT

A relay has a case, a first fixed terminal including a first fixed contact, a second fixed terminal including a second fixed contact, a movable touch piece including a first movable contact that is disposed facing the first fixed contact and a second movable contact that is disposed facing the second fixed contact, the movable touch piece being disposed in the case and disposed so as to be movable in a direction in which the first movable contact and the second movable contact come into contact with the first fixed contact and the second fixed contact and in a direction in which the first movable contact and the second movable contact separate from the first fixed contact and the second fixed contact. The first fixed terminal includes a first contact support disposed in the case and configured to support the first fixed contact.

20 Claims, 16 Drawing Sheets

(56) References Cited

U.S. PATENT DOCUMENTS

| | | | | |
|---|---|---|---|---|
| 8,138,872 | B2 * | 3/2012 | Yoshihara | H01H 51/2209 335/281 |
| 8,698,582 | B2 * | 4/2014 | Uchida | H01H 1/54 335/147 |
| 8,816,801 | B2 * | 8/2014 | Tachikawa | H01H 3/222 335/147 |
| 8,841,979 | B2 * | 9/2014 | Uchida | H01H 50/546 335/195 |
| 8,981,883 | B2 * | 3/2015 | Naka | H01H 50/546 335/196 |
| 2013/0021122 | A1 * | 1/2013 | Uchida | H01H 1/54 335/131 |
| 2015/0213984 | A1 | 7/2015 | Naka et al. | |
| 2016/0233039 | A1 | 8/2016 | Kanematsu et al. | |
| 2018/0009399 | A1 | 1/2018 | Pal | |
| 2019/0066951 | A1 | 2/2019 | Kanematsu et al. | |
| 2019/0066956 | A1 * | 2/2019 | Konishi | H01H 1/58 |

FOREIGN PATENT DOCUMENTS

| | | | |
|---|---|---|---|
| CN | 105531783 | A | 4/2016 |
| JP | 2014-099373 | A | 5/2014 |

* cited by examiner

RELAY

CROSS-REFERENCE TO RELATED APPLICATION

This application claims priority to Japanese Patent Application No. 2018-068870 filed with the Japan Patent Office on Mar. 30, 2018, the entire contents of which are incorporated herein by reference.

BACKGROUND

Field

The present invention relates to a relay.

Related Art

A relay is provided with a movable touch piece including a movable contact, and a fixed terminal including a fixed contact. The movable touch piece operates and the movable contact comes in contact with or separates from the fixed contact so that the contacts are opened and closed. Some conventional relays have a shape in which fixed terminals are folded back in a case of the relay. For example, in an electromagnetic contactor disclosed in Japanese Unexamined Patent Publication No. 2014-099373, the fixed terminal has a C-shaped portion. The C-shaped portion is disposed in the case and is connected to an external connection disposed outside the case.

In the relay, heat is generated at the contact by energization. In the electromagnetic contactor disclosed in the Japanese Unexamined Patent Publication No. 2014-099373 described above, the heat generated at the contact is transmitted to the external connection via the C-shaped portion. Thus, cooling the external connection can cool the contact.

SUMMARY

However, in the electromagnetic contactor disclosed in Japanese Unexamined Patent Publication No. 2014-099373, the external connection is provided at a position farthest from the contact in the heat transmission path at the fixed terminal. Therefore, even when the external connection is cooled, it is difficult to obtain high cooling efficiency. [0006] One or more embodiments of the present invention improves the cooling efficiency of contacts in a relay.

A relay according to one aspect is provided with a case, a first fixed terminal, a second fixed terminal, and a movable touch piece. The first fixed terminal includes a first fixed contact. The second fixed terminal includes a second fixed contact. The movable touch piece includes a first movable contact and a second movable contact. The first movable contact is disposed facing the first fixed contact. The second movable contact is disposed facing the second fixed contact. The movable touch piece is disposed in the case. The movable touch piece is disposed so as to be movable in a direction in which the first movable contact and the second movable contact come into contact with the first fixed contact and the second fixed contact and in a direction in which the first movable contact and the second movable contact separate from the first fixed contact and the second fixed contact.

The first fixed terminal includes a first contact support, a first extension, a first intermediate portion, and a first external connection. The first contact support is disposed in the case and supports the first fixed contact. The first extension is disposed in the case and extends in a first direction. The first direction is a direction from the first movable contact to the second movable contact. The first external connection is connected to the first extension and is disposed outside the case. The first intermediate portion connects the first contact support and the first extension and has a shape folded back from the first contact support toward the first extension. At least a part of the first intermediate portion is disposed so as to be exposed to the outside of the case.

In the relay according to the present aspect, at least a part of the first intermediate portion is disposed so as to be exposed to the outside of the case. Therefore, the portion of the first intermediate portion that is exposed to the outside can be cooled. The first intermediate portion is positioned between the first fixed contact and the first external connection in a heat transmission path at the first fixed terminal. Therefore, by cooling the first intermediate portion, it is possible to effectively cool the contacts as compared with a configuration where the first external connection is cooled. Hence it is possible to improve the cooling efficiency of the contact.

The first intermediate portion may include a first flat surface. The first flat surface may be disposed so as to be exposed to the outside of the case. In this instance, by cooling the first flat surface, the cooling efficiency of the contact can be improved.

The first flat surface may extend from the outer side surface of the case in a direction intersecting the outer side surface. In this instance, it is possible to easily bring an external cooling body into contact with the first flat surface. Hence the first intermediate portion can be cooled easily.

The first flat surface may be disposed to be flush with the external connection. In this instance, it is possible to easily connect the external connection and the first flat surface to the common substrate of the external circuit. Hence it is possible to increase the ease of attachment of the relay.

The first intermediate portion may be exposed to the outside from the first outer side surface of the case. The first flat surface may be disposed along the first outer side surface. In this instance, it is possible to easily bring an external cooling body into contact with the first flat surface. Hence the first intermediate portion can be cooled easily.

The first fixed terminal may include a first fixed touch piece and a first bus bar. The first fixed touch piece may include a first contact support. The first bus bar includes the first extension and may be separate from the first fixed touch piece. The first intermediate portion may include a first attachment portion and a second attachment portion. The first attachment portion may be formed integrally with the fixed touch piece. The second attachment portion may be formed integrally with the first bus bar and attached to the first attachment portion. The first attachment portion and the second attachment portion may be disposed so as to be exposed to the outside of the case. In this instance, the first attachment portion and the second attachment portion are disposed outside the case. This facilitates connecting or separating the first attachment portion and the second attachment portion. In addition, the first attachment portion and the second attachment portion disposed outside the case can be used as a portion for cooling the contact.

The first extension may extend to a position beyond the first fixed contact in the first direction. In this instance, the first extension, through which a current flows in the opposite direction to the movable touch piece, has a large length. It is thus possible to increase an electromagnetic repulsive force acting on the movable touch piece in the direction in which the first movable contact is pressed against the first fixed contact. As a result, it is possible to ensure large contact pressure of the contacts. In addition, when the first extension is long, a distance from the first fixed contact to the first external connection is increased, while a large electromagnetic repulsive force is obtained. Thus, the effect of being able to improve the cooling efficiency is enhanced by cooling the first intermediate portion.

The first extension may extend to a position beyond the second fixed contact in the first direction. In this instance, a larger electromagnetic repulsive force can be obtained by increasing the length of the first extension. In addition, since the distance from the first fixed contact to the first external connection is increased, the effect of improving the cooling efficiency is enhanced by cooling the first intermediate portion.

The first extension may be embedded in the case. Alternatively, the first extension may be disposed in the housing space in the case.

The second fixed terminal may include a second contact support, a second extension, a second external connection, and a second intermediate portion. The second contact support may be disposed in the case and support the second fixed contact. The second extension may be disposed in the case and extend in a second direction. The second direction is a direction from the second movable contact to the first movable contact. The second external connection may be connected to the second extension and disposed outside the case. The second intermediate portion may connect the second contact support and the second extension. At least a part of the second intermediate portion may be disposed so as to be exposed to the outside of the case. In this instance, at least a part of the second intermediate portion is disposed so as to be exposed to the outside of the case. Therefore, the portion of the second intermediate portion that is exposed to the outside can be cooled. The second intermediate portion is positioned between the second fixed contact and the second external connection in a heat transmission path at the second fixed terminal. Therefore, by cooling the second intermediate portion, it is possible to effectively cool the contacts as compared with a configuration where the second external connection is cooled. Hence it is possible to improve the cooling efficiency of the contact.

The first intermediate portion may include a first flat surface. The first flat surface may be disposed so as to be exposed to the outside of the case. The second intermediate portion may include a second flat surface. The second flat surface may be disposed so as to be exposed to the outside of the case. The first flat surface and the second flat surface may be positioned at the same height. In this instance, the first flat surface and the second flat surface can be easily cooled by an external cooling body.

The first flat surface and the second flat surface may be disposed to be flush with each other. In this instance, the first flat surface and the second flat surface can be easily cooled by an external cooling body provided on a common substrate.

According to one or more embodiments of the present invention, it is possible to improve the cooling efficiency of contacts in a relay.

DETAILED DESCRIPTION

Figure 1:
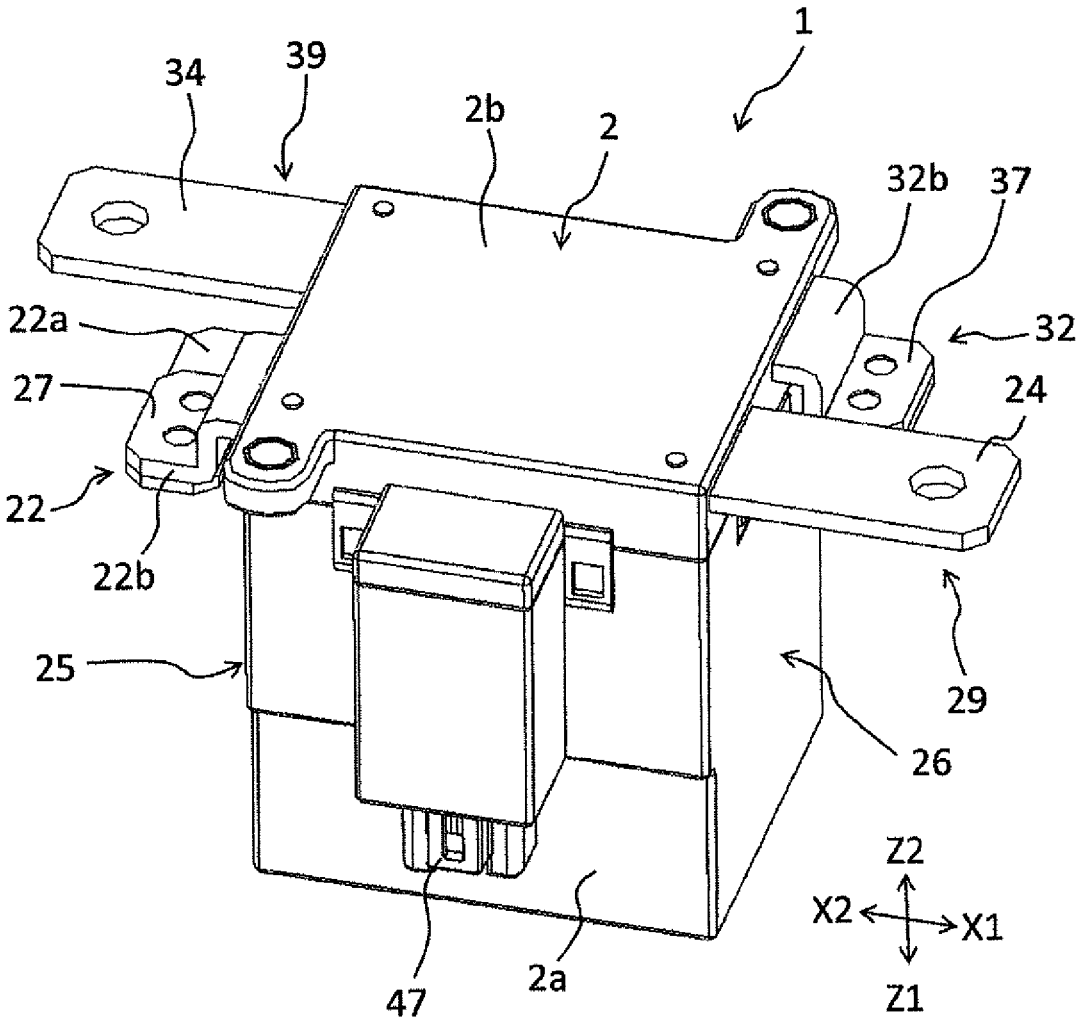
FIG. 1 is a perspective view of a relay according to an embodiment.
Figure 2:
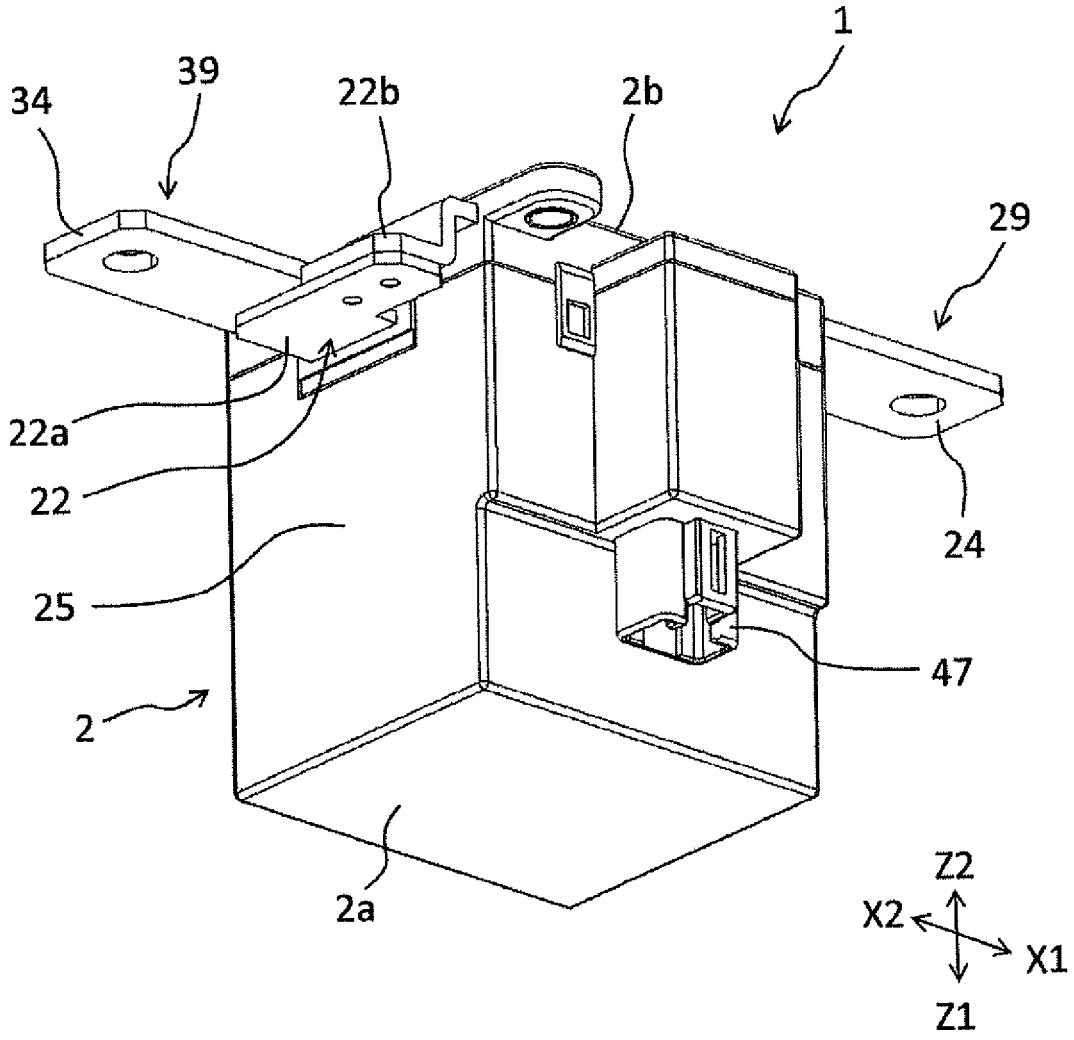
FIG. 2 is a perspective view of the relay.
Figure 3:
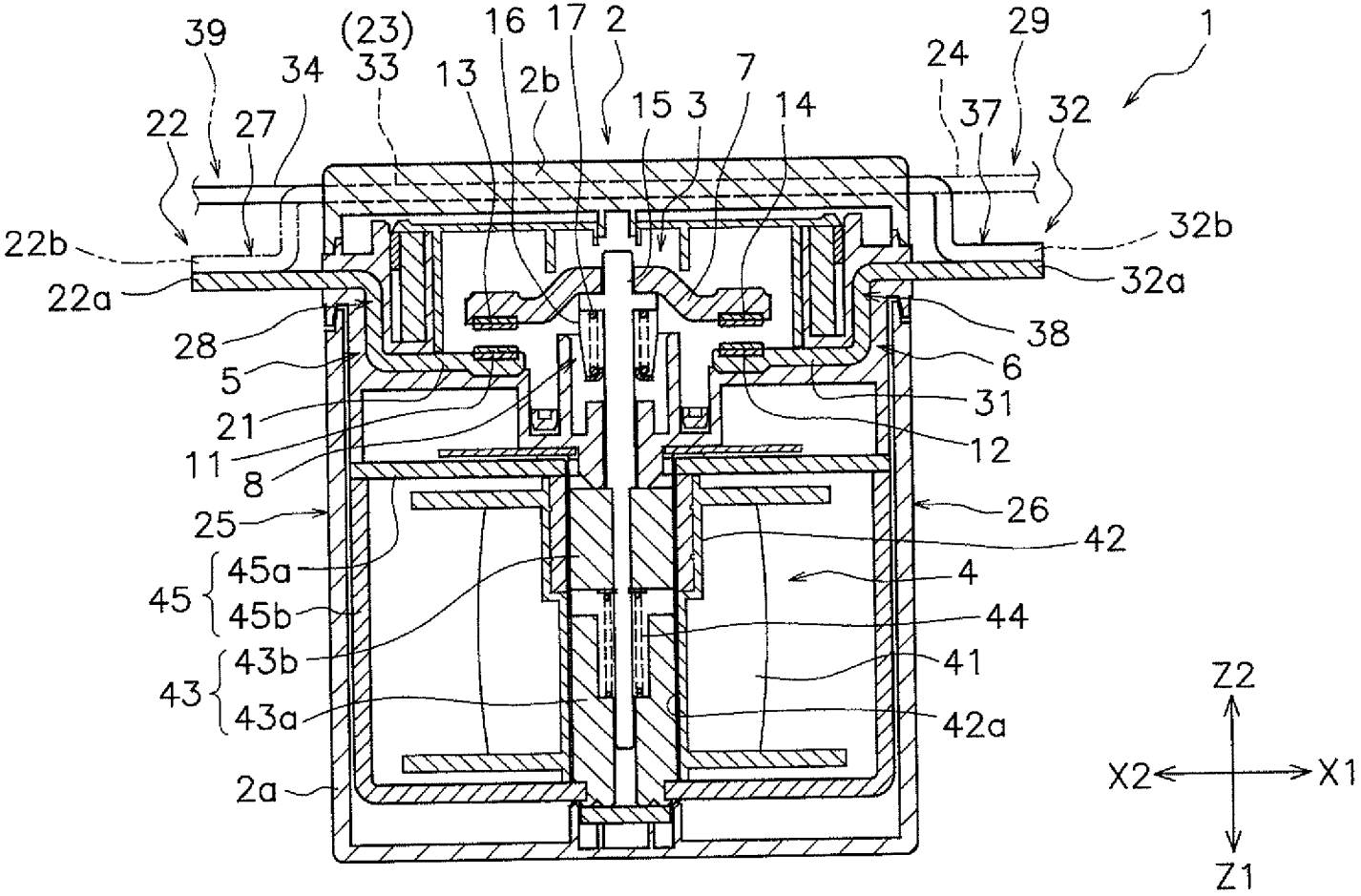
FIG. 3 is a sectional view of the relay.

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIGS. 1 and 2 are perspective views illustrating the relay 1 according to one or more embodiments of the present invention. FIG. 3 is a sectional view of the relay 1. As illustrated in FIG. 3, the relay 1 includes a case 2, a contact device 3, and a drive device 4.

The case 2 accommodates the contact device 3 and the drive device 4. The case 2 is formed of a resin having insulation. The case 2 includes a case body 2*a* and a lid portion 2*b*. The contact device 3 and the drive device 4 are disposed in the case body 2*a*. The lid portion 2*b* is separate from the case body 2*a*. The lid portion 2*b* is attached to the case body 2*a*.

The contact device 3 includes a first fixed terminal 5, a second fixed terminal 6, a movable touch piece 7, and a touch piece holding portion 8. The first fixed terminal 5, the second fixed terminal 6, and the movable touch piece 7 are formed of a material having conductivity. The first fixed terminal 5 includes a first fixed contact 11. The second fixed terminal 6 includes a second fixed contact 12. The first fixed contact 11 and the second fixed contact 12 are disposed apart from each other in a longitudinal direction of the movable touch piece 7 (a right-left direction in FIG. 3).

The movable touch piece 7 includes a first movable contact 13 and a second movable contact 14. The first movable contact 13 is disposed facing the first fixed contact 11. The second movable contact 14 is disposed facing the second fixed contact 12. The movable touch piece 7 is disposed movably in a contact direction (Z1) and a separation direction (Z2).

The contact direction (Z1) is a direction (downward in FIG. 3) in which the first movable contact 13 and the second movable contact 14 come into contact with the first fixed contact 11 and the second fixed contact 12. The separation direction (Z2) is a direction (upward in FIG. 3) in which the first movable contact 13 and the second movable contact 14 separate from the first fixed contact 11 and the second fixed contact 12. In the following description, a direction from the first movable contact 13 to the second movable contact 14 (the right side in FIG. 3) is referred to as a "first direction (X1)." Further, a direction from the second movable contact 14 to the first movable contact 13 (leftward in FIG. 3) is referred to as a "second direction (X2)."

The touch piece holding portion 8 holds the movable touch piece 7. The touch piece holding portion 8 includes a drive shaft 15, a holder 16, and a contact spring 17. The drive shaft 15 extends in a movement direction (Z1, Z2) of the movable touch piece 7. The drive shaft 15 is disposed movably in the contact direction (Z1) and the separation direction (Z2). The holder 16 is connected to the movable touch piece 7 and holds the movable touch piece 7. The contact spring 17 is disposed between the drive shaft 15 and the holder 16.

The first fixed terminal 5 includes a first contact support 21, a first intermediate portion 22, a first extension 23, and a first external connection 24. The first contact support 21 supports the first fixed contact 11. The first contact support 21 extends in the second direction (X2) from the first fixed contact 11 in the case 2.

The first intermediate portion 22 connects the first contact support 21 and the first extension 23. At least a part of the first intermediate portion 22 is disposed so as to be exposed to the outside of the case 2. The case 2 includes a first outer side surface 25 and a second outer side surface 26. The first outer side surface 25 and the second outer side surface 26 extend in the movement direction (Z1, Z2) of the movable touch piece 7. The first intermediate portion 22 protrudes in the second direction (X2) from the first outer side surface 25 of the case 2. That is, the first intermediate portion 22 is exposed to the outside from the first outer side surface 25 of the case 2.

The first intermediate portion 22 has a shape folded from the first contact support 21 toward the first extension 23. The first intermediate portion 22 includes a first flat surface 27. The first flat surface 27 is disposed so as to be exposed to the outside of the case 2. The first flat surface 27 is disposed parallel to the first external connection 24. The first flat surface 27 extends in the second direction (X2) from the first outer side surface 25 of the case 2.

The first extension 23 is disposed apart from the movable touch piece 7 in the separation direction (Z2). The first extension 23 has a flat plate shape. The first extension 23 extends in the first direction (X1). The first extension 23 extends in the first direction (X1) from the first intermediate portion 22 to a position beyond the first fixed contact 11 and the second fixed contact 12. The first extension 23 extends over the entire width of the case 2 in the first direction (X1).

The first external connection 24 is connected to the first extension 23 and protrudes from the second outer side surface 26 of the case 2 in the first direction (X1). The first external connection 24 is a portion to be connected to an external circuit to which the relay 1 is attached. The first external connection 24 is formed integrally with the first extension 23. However, the first external connection 24 may be separate from the first extension 23. The first external connection 24 has a flat plate shape.

In the present embodiment, the first fixed terminal 5 includes a first fixed touch piece 28 and a first bus bar 29. The first bus bar 29 and the first fixed touch piece 28 are separate from each other. The first bus bar 29 is connected to the first fixed touch piece 28. The first fixed touch piece 28 extends in the second direction (X2) from the first fixed contact 11. An end portion of the first fixed touch piece 28 protrudes outward of the case 2. The end portion of the first fixed touch piece 28 is connected to the first bus bar 29 outside the case 2.

The first fixed touch piece 28 is connected to the first bus bar 29 by welding, for example. However, the first fixed touch piece 28 may be connected to the first bus bar 29 by another fixing method. For example, the first fixed touch piece 28 may be connected to the first bus bar 29 by screws. Alternatively, the first fixed touch piece 28 may be formed integrally with the first bus bar 29.

The first fixed touch piece 28 includes the first contact support 21 described above. The first bus bar 29 includes the first extension 23 and the first external connection 24 described above. The first intermediate portion 22 includes a first attachment portion 22*a* included in the first fixed touch piece 28 and a second attachment portion 22*b* included in the first bus bar 29. The first attachment portion 22*a* is formed integrally with the first contact support 21 in the first fixed touch piece 28. The second attachment portion 22*b* is formed integrally with the first extension 23 in the first bus bar 29. However, the first attachment portion 22*a* may be separate from the first contact support 21. The second attachment portion 22*b* may be separate from the first extension 23. The first attachment portion 22*a* and the second attachment portion 22*b* are disposed so as to be exposed to the outside of the case 2.

As illustrated in FIG. 2, the first attachment portion 22*a* has a shape bent toward the first bus bar 29. The second attachment portion 22*b* has a shape bent from the first attachment portion 22*a* toward the first extension 23. The second attachment portion 22*b* is connected to the first attachment portion 22*a*. For example, the second attachment portion 22*b* is connected to the first attachment portion 22*a* by welding. However, the second attachment portion 22*b* may be connected to the first attachment portion 22*a* by another fixing method. For example, the second attachment portion 22*b* may be connected to the first attachment portion 22*a* by screws.

The second fixed terminal 6 has a shape symmetrical with the first fixed terminal 5. The second fixed terminal 6 includes a second contact support 31, a second intermediate portion 32, a second extension 33, and a second external connection 34. The second contact support 31 supports the second fixed contact 12. The second contact support 31 extends in the first direction (X1) from the second fixed contact 12 in the case 2.

The second intermediate portion 32 connects the second contact support 31 and the second extension 33. At least a part of the second intermediate portion 32 is disposed so as to be exposed to the outside of the case 2. The second intermediate portion 32 protrudes in the first direction (X1) from the second outer side surface 26 of the case 2. That is, the second intermediate portion 32 is exposed to the outside from the second outer side surface 26 of the case 2.

The second intermediate portion 32 has a shape folded back from the second contact support 31 toward the second extension 33. The second intermediate portion 32 includes a second flat surface 37. The second flat surface 37 is disposed so as to be exposed to the outside of the case 2. The second flat surface 37 is disposed parallel to the second external connection 34. The second flat surface 37 extends in the first direction (X1) from the second outer side surface 26 of the case 2.

The second extension 33 is disposed apart from the movable touch piece 7 in the separation direction (Z2). The second extension 33 has a flat plate shape. The second extension 33 extends in the second direction (X2). The second extension 33 extends in a second direction (X2) from the second intermediate portion 32 to a position beyond the second fixed contact 12 and the first fixed contact 11. The second extension 33 extends over the entire width of the case 2 in the second direction (X2).

The second external connection 34 is connected to the second extension 33 and protrudes in the second direction (X2) from the first outer side surface 25 of the case 2. The second external connection 34 is a portion connected to the external circuit. The second external connection 34 is formed integrally with the second extension 33. However, the second external connection 34 may be separate from the second extension 33. The second external connection 34 has a flat plate shape.

In the present embodiment, the second fixed terminal 6 includes a second fixed touch piece 38 and a second bus bar 39. The second bus bar 39 is separate from the second fixed touch piece 38. The second bus bar 39 is connected to the second fixed touch piece 38. The second fixed touch piece 38 extends in the first direction (X1) from the second fixed contact 12. An end portion of the second fixed touch piece 38 protrudes outward of the case 2. The end portion of the second fixed touch piece 38 is connected to the second bus bar 39 outside the case 2.

The second fixed touch piece 38 is connected to the second bus bar 39 by welding, for example. However, the second fixed touch piece 38 may be connected to the second bus bar 39 by another fixing method. For example, the second fixed touch piece 38 may be connected to the second bus bar 39 by screws. Alternatively, the second fixed touch piece 38 may be formed integrally with the second bus bar 39.

The second fixed touch piece 38 includes the second contact support 31 described above. The second bus bar 39 includes the second extension 33 and the second external connection 34. The second intermediate portion 32 includes a first attachment portion 32*a* included in the second fixed touch piece 38 and a second attachment portion 32*b* included in the second bus bar 39. The first attachment portion 32*a* is formed integrally with the second contact support 31 in the second fixed touch piece 38. The second attachment portion 32*b* is formed integrally with the second extension 33 in the second bus bar 39. However, the first attachment portion 32*a* may be separate from the second contact support 31. The second attachment portion 32*b* may be separate from the second extension 33. The first attachment portion 32*a* and the second attachment portion 32*b* are disposed so as to be exposed to the outside of the case 2.

The first attachment portion 32*a* has a shape bent toward the second bus bar 39. The first attachment portion 32*a* is connected to the second attachment portion 32*b*. The second attachment portion 32*b* has a shape bent from the first attachment portion 32*a* toward the second extension 33. For example, the first attachment portion 32*a* is connected to the second attachment portion 32*b* by welding. However, the first attachment portion 32*a* may be connected to the second attachment portion 32*b* by another fixing method. For example, the first attachment portion 32*a* may be connected to the second attachment portion 32*b* by screws.

Figure 5:
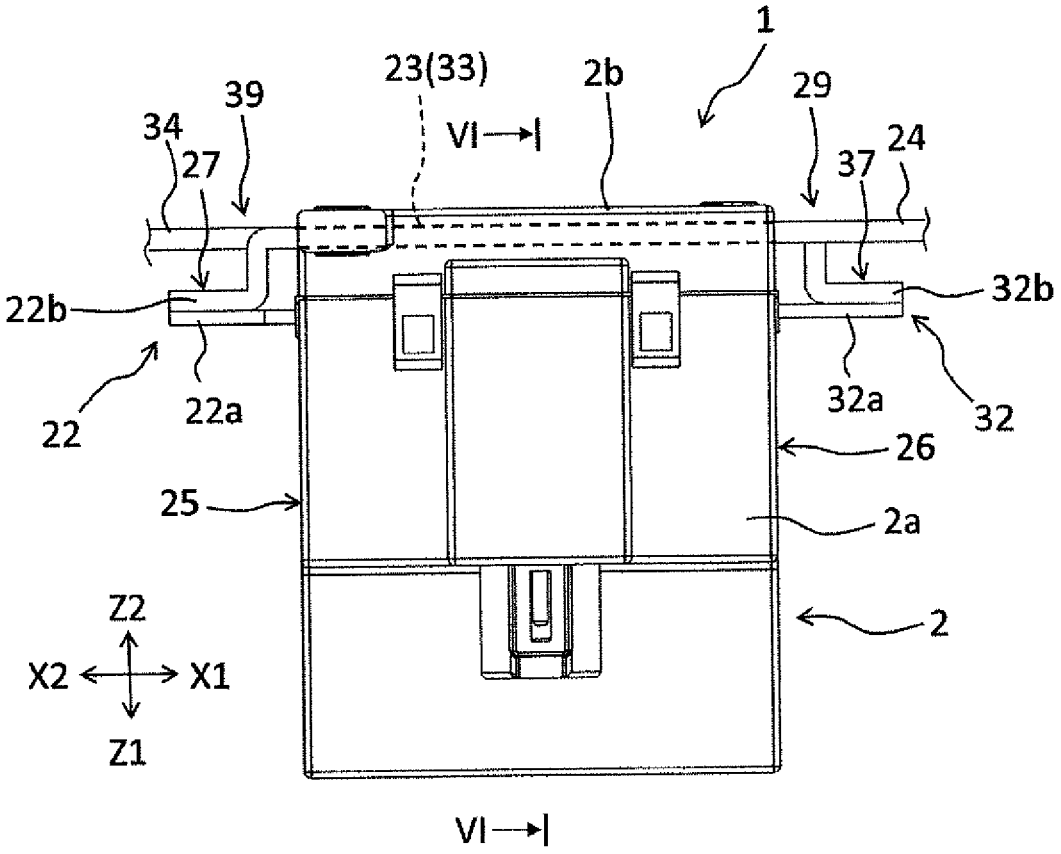
FIG. 5 is a front view of the relay.
Figure 6:
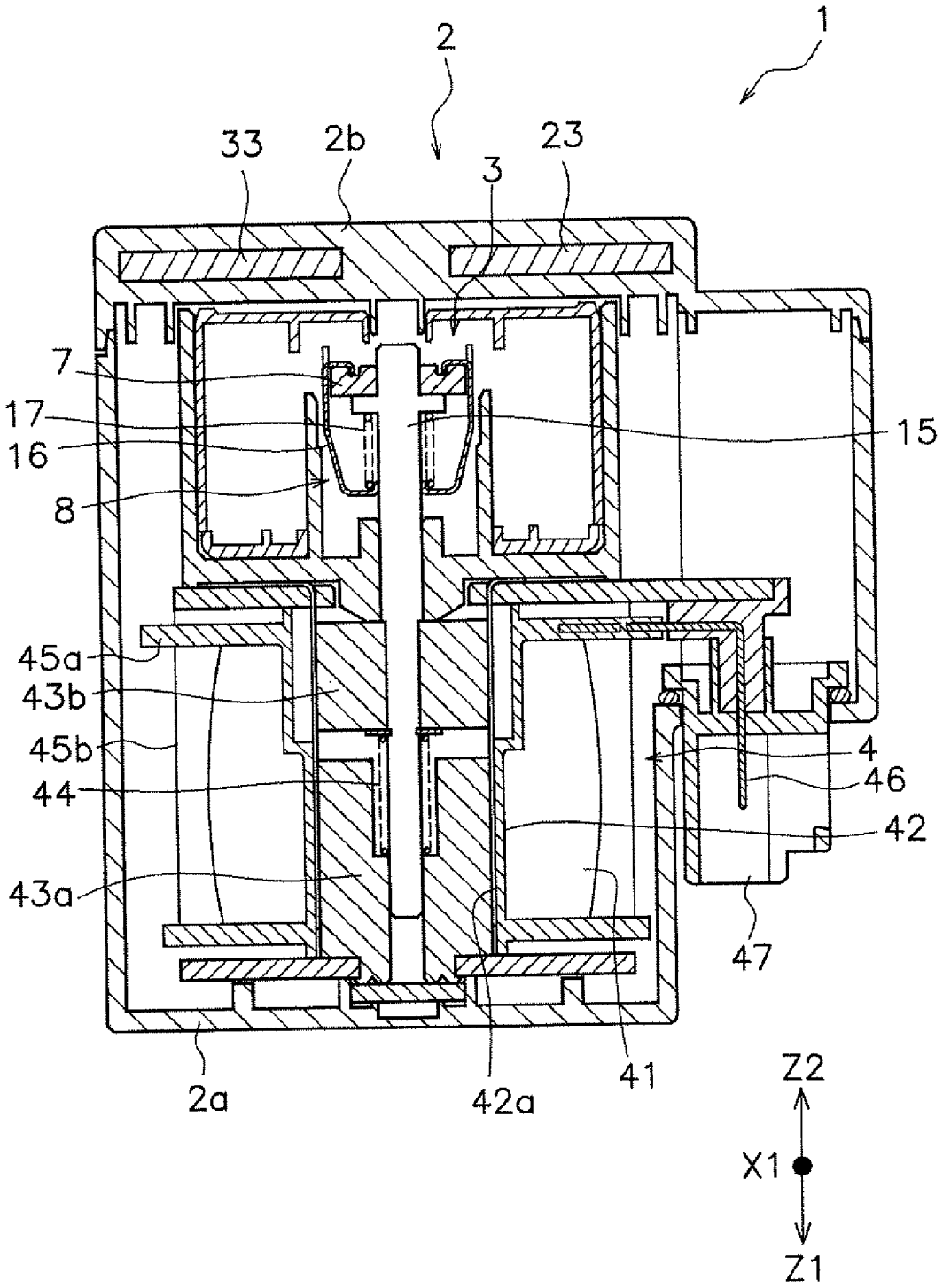
FIG. 6 is a sectional view taken along line VI-VI in FIG. 5.

FIG. 6 is a sectional view taken along a line VI-VI in FIG. 5. As illustrated in FIG. 6, the first extension 23 and the second extension 33 are embedded in the case 2. Specifically, the first extension 23 and the second extension 33 are embedded in the lid portion 2*b*.

Figure 4:
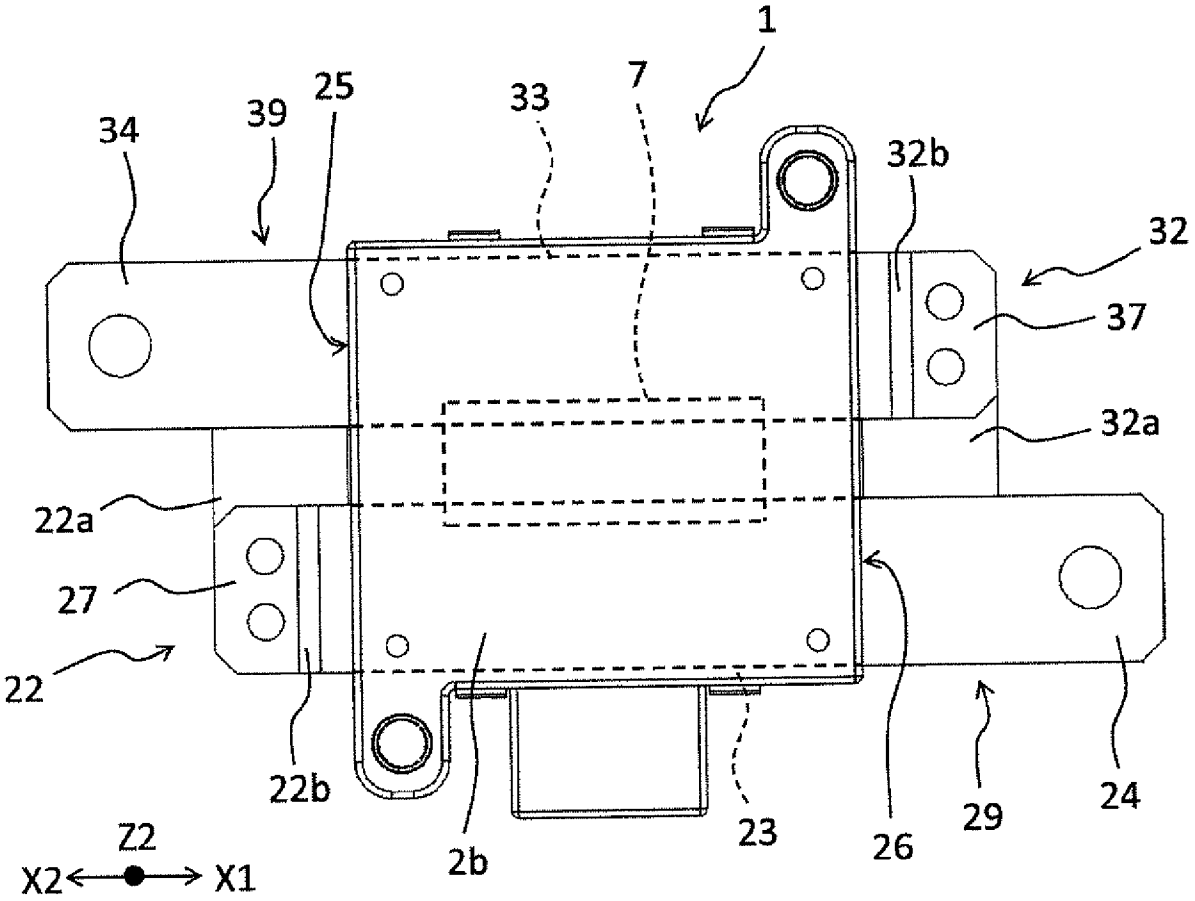
FIG. 4 is a plan view of the relay.

As illustrated in FIG. 4, a part of the first extension 23 overlaps with the movable touch piece 7 as viewed in the movement direction (Z1, Z2) of the movable touch piece 7. A part of the second extension 33 overlaps with the movable touch piece 7 as viewed in the movement direction (Z1, Z2) of the movable touch piece 7.

The first extension 23 and the second extension 33 are disposed at the same height with the movement direction (Z1, Z2) of the movable touch piece 7 as a height direction. The first extension 23 and the second extension 33 are disposed to be flush with each other. The first external connection 24 and the second external connection 34 are disposed at the same height with the movement direction (Z1, Z2) of the movable touch piece 7 as the height direction. The first external connection 24 and the second external connection 34 are disposed to be flush with each other. The first flat surface 27 and the second flat surface 37 are disposed at the same height with the movement direction (Z1, Z2) of the movable touch piece 7 as the height direction. The first flat surface 27 and the second flat surface 37 are disposed to be flush with each other.

Next, the drive device 4 will be described. The drive device 4 generates a driving force for operating the movable touch piece 7. The drive device 4 operates the movable touch piece 7 by an electromagnetic force. The drive device 4 includes a coil 41, a spool 42, a core 43, a return spring 44, and a yoke 45.

The coil 41 is wound around the spool 42. The coil 41 and the spool 42 are disposed coaxially with the drive shaft 15. The coil 41 is connected to the coil terminal 46 illustrated in FIG. 6. As illustrated in FIG. 6, the tip of the coil terminal 46 is disposed in a connector 47.

The spool 42 includes a hole 42*a* penetrating in an axial direction of the spool 42. The iron core 43 and the return spring 44 are inserted into a hole 42*a* of the spool 42, The iron core 43 includes a fixed iron core 43*a* and a movable iron core 43*b*. The fixed iron core 43*a* is fixed to a second yoke 45*b*, the spool 42, or the case 2. The yoke 45 is connected to the iron core 43.

The yoke 45 includes a first yoke 45*a* and a second yoke 45*b*. The first yoke 45*a* is disposed between the contact device 3 and the spool 42. The second yoke 45*b* is connected to the first yoke 45*a*. The second yoke 45*b* has a U-shape. The second yoke 45*b* is disposed on each side of the coil 41 and on the side opposite to the first yoke 45*a* with respect to the coil 41. The first yoke 45*a* is connected to one end of the iron core 43. The second yoke 45*b* is connected to the other end of the iron core 43.

The iron core 43 includes a fixed iron core 43*a* and a movable iron core 43*b*. The fixed iron core 43*a* is fixed to the second yoke 45*b*. The movable iron core 43*b* is separate from the fixed iron core 43*a*. The movable iron core 43*b* is disposed movably in the contact direction (Z1) and the separation direction (Z2). The movable iron core 43*b* is connected to the drive shaft 15. The return spring 44 is disposed between the movable iron core 43*b* and the fixed iron core 43*a*. The return spring 44 urges the movable iron core 43*b* in the separation direction (Z2).

Next, the operation of the relay 1 will be described. When no voltage is applied to the coil 41, the drive shaft 15 is pressed, together with the movable iron core 43*b*, in the separation direction (Z2) by an elastic force of the return spring 44. Therefore, the movable touch piece 7 is also pressed in the separation direction (Z2), and the first movable contact 13 and the second movable contact 14 are in an open state, being separated from the first fixed contact 11 and the second fixed contact 12.

When a voltage is applied to the coil 41 and excited, the movable iron core 43*b* moves in the contact direction (Z1) against the elastic force of the return spring 44. Thus, by movement of the drive shaft 15 and the movable touch piece 7 in the contact direction (Z1), the first movable contact 13 and the second movable contact 14 are brought into a closed state, being in contact with the first fixed contact 11 and the second fixed contact 12. In this closed state, a current flows from the first fixed terminal 5 to the second fixed terminal 6 through the movable touch piece 7.

Figure 7:
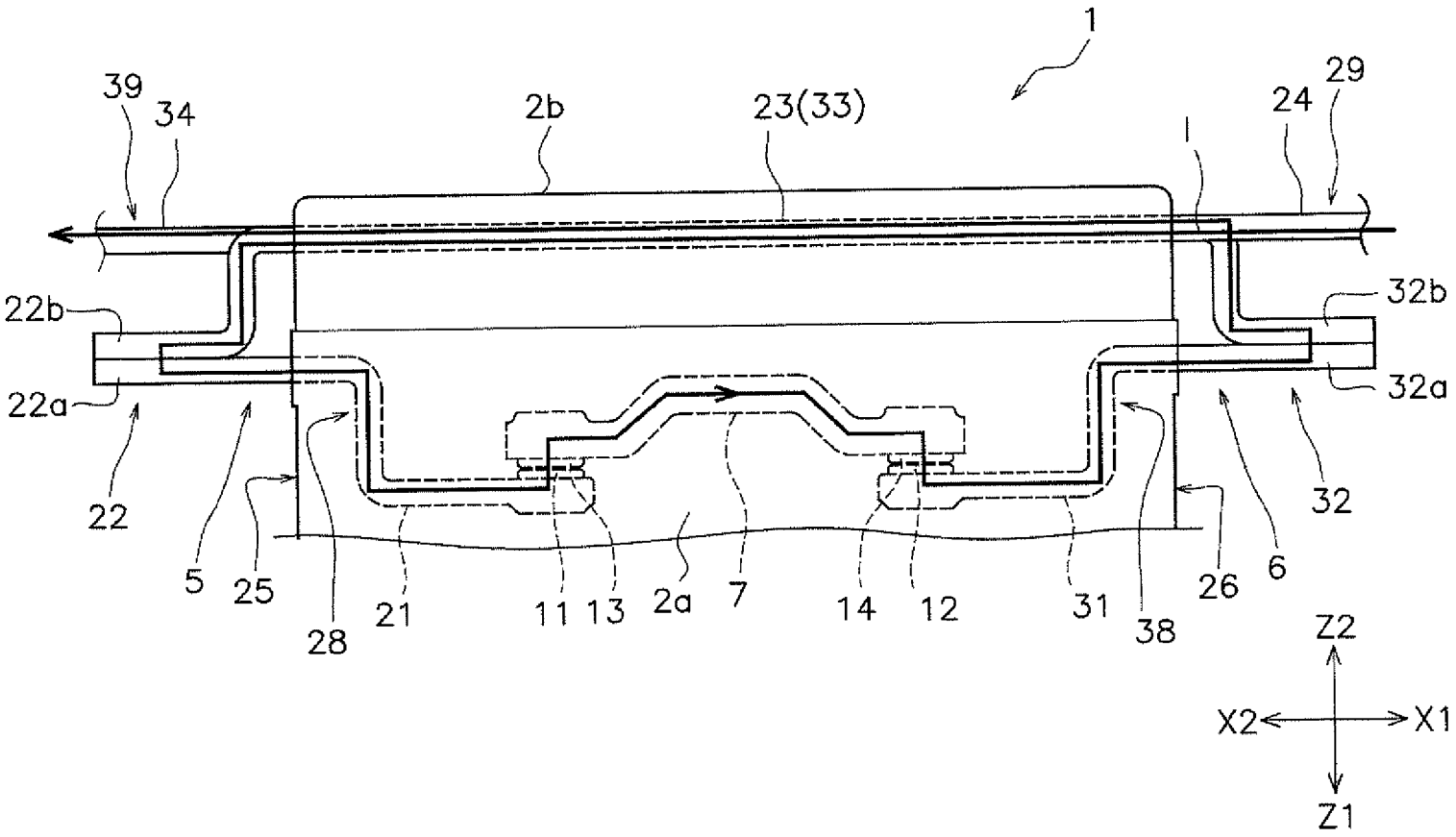
FIG. 7 is a schematic diagram illustrating a current flow in the relay in a closed state.

FIG. 7 is a diagram illustrating the flow of the current I in the closed state. As illustrated in FIG. 7, the current I flows from the first external connection 24 to the movable touch piece 7 through the first extension 23, the first intermediate portion 22, the first contact support 21, the first fixed contact 11, and the first movable contact 13. The current I passes from the movable touch piece 7 through the second movable contact 14, the second fixed contact 12, the second contact support 31, the second intermediate portion 32, and the second extension 33, and the second external connection 34.

In the relay 1 according to the present embodiment, the first extension 23 extends in a first direction (X1) from the first movable contact 13 to the second movable contact 14, and the first external connection 24 connected to the first extension 23 protrudes in the first direction (X1) from the case 2. The current I flows in the first extension 23 in a direction opposite to that of the movable touch piece 7. Hence in the first fixed terminal 5, it is possible to ensure a large section in which the current I flows in the opposite direction to the movable touch piece 7. This enables an increase in electromagnetic repulsive force acting on the movable touch piece 7.

Further, the second extension 33 extends in the second direction (X2) from the second movable contact 14 to the first movable contact 13, and the second external connection 34 connected to the second extension 33 protrudes in the second direction (X2) from the case 2. A current I flows in the second extension 33 in a direction opposite to that of the movable touch piece 7. Therefore, in the second fixed terminal 6, it is possible to ensure a large section in which the current I flows in the opposite direction to the movable touch piece 7. Thereby, the electromagnetic repulsive force acting on the movable touch piece 7 can be further increased.

As described above, in the relay according to the present embodiment, a current flows in the first extension 23 and the second extension 33 in a direction opposite to that of the movable touch piece 7, thereby increasing the electromagnetic repulsive force acting on the movable touch piece 7. This can increase the contact pressure between the first movable contact 13 and the first fixed contact 11 and the contact pressure between the second movable contact 14 and the second fixed contact 12.

In the relay 1 according to the present embodiment, at least a part of the first intermediate portion 22 of the first fixed terminal 5 is disposed so as to be exposed to the outside of the case 2. Therefore, the portion of the first intermediate portion 22 that is exposed to the outside can be cooled. The first intermediate portion 22 is positioned between the first fixed contact 11 and the first external connection 24 in a heat transmission path at the first fixed terminal 5. Therefore, by cooling the first intermediate portion 22, it is possible to effectively cool the contacts as compared with a configuration where the first external connection 24 is cooled. Hence it is possible to improve the cooling efficiency of the contact.

The first flat surface 27 of the first intermediate portion 22 is disposed so as to be exposed to the outside of the case 2. Therefore, by cooling the first flat surface 27, the cooling efficiency of the contacts can be improved.

The first flat surface 27 extends in the second direction (X2) from the first outer side surface 25 of the case 2. It is thus possible to easily bring the external cooling body into contact with the first flat surface 27. Hence the first intermediate portion 22 can be cooled easily.

The first attachment portion 22*a* of the first fixed touch piece 28 and the second attachment portion 22*b* of the first bus bar 29 are disposed so as to be exposed to the outside of the case 2. This facilitates connecting or separating the first fixed touch piece 28 and the first bus bar 29. In addition, the first attachment portion 22*a* and the second attachment portion 22*b* disposed outside the case 2 can be used as a portion for cooling the contacts.

The first extension 23 extends to a position beyond the first fixed contact 11 and the second fixed contact 12 in the first direction (X1). Therefore, as described above, it is possible to increase the electromagnetic repulsive force acting on the movable touch piece 7 and ensure large contact pressure of the contacts. In addition, when the first extension 23 is long, a distance from the first fixed contact 11 to the first external connection 24 is increased, while a large electromagnetic repulsive force is obtained. Thus, the effect of being able to improve the cooling efficiency is enhanced by cooling the first intermediate portion 22.

At least a part of the second intermediate portion 32 of the second fixed terminal 6 is disposed so as to be exposed to the outside of the case 2. Therefore, a similar effect to that of the first intermediate portion 22 can be obtained for the second intermediate portion 32.

The first flat surface 27 of the first intermediate portion 22 and the second flat surface 37 of the second intermediate portion 32 are disposed at the same height. In addition, the first flat surface 27 and the second flat surface 37 are disposed to be flush with each other. It is thus possible to easily cool the first flat surface 27 and the second flat surface 37 with an external cooling body. For example, the first flat surface 27 and the second flat surface 37 can be easily brought into contact with an external cooling body attached to a common substrate.

Although embodiments of the present invention are described above, the present invention is not limited to the above embodiments, and various changes can be made in the scope not deviating from the gist of the present invention. For example, the configuration of the drive device 4 may be changed. The shape or placement of the coil 41, the spool 42, the iron core 43, the return spring 44, or the yoke 45 may be changed. The shape or placement of the case 2 may be changed.

The shape or placement of the first fixed terminal 5, the second fixed terminal 6, and the movable touch piece 7 may be changed. For example, the placement of the first fixed terminal 5 and the second fixed terminal 6 is not limited to that of the embodiment described above, and may be interchanged.

In the above embodiment, by the drive device 4 drawing the drive shaft 15 toward the coil 41 side, the movable touch piece 7 moves in the contact direction (Z1). By the drive device 4 pushing the drive shaft 15 from the coil 41 side, the movable touch piece 7 moves in the separation direction (Z2). However, by the drive device 4 drawing the drive shaft 15 toward the coil 41 side, the movable touch piece 7 may move in the separation direction (Z2). By the drive device 4 pushing the drive shaft 15 from the coil 41 side, the movable touch piece 7 may move in the contact direction (Z1).

Figure 8:
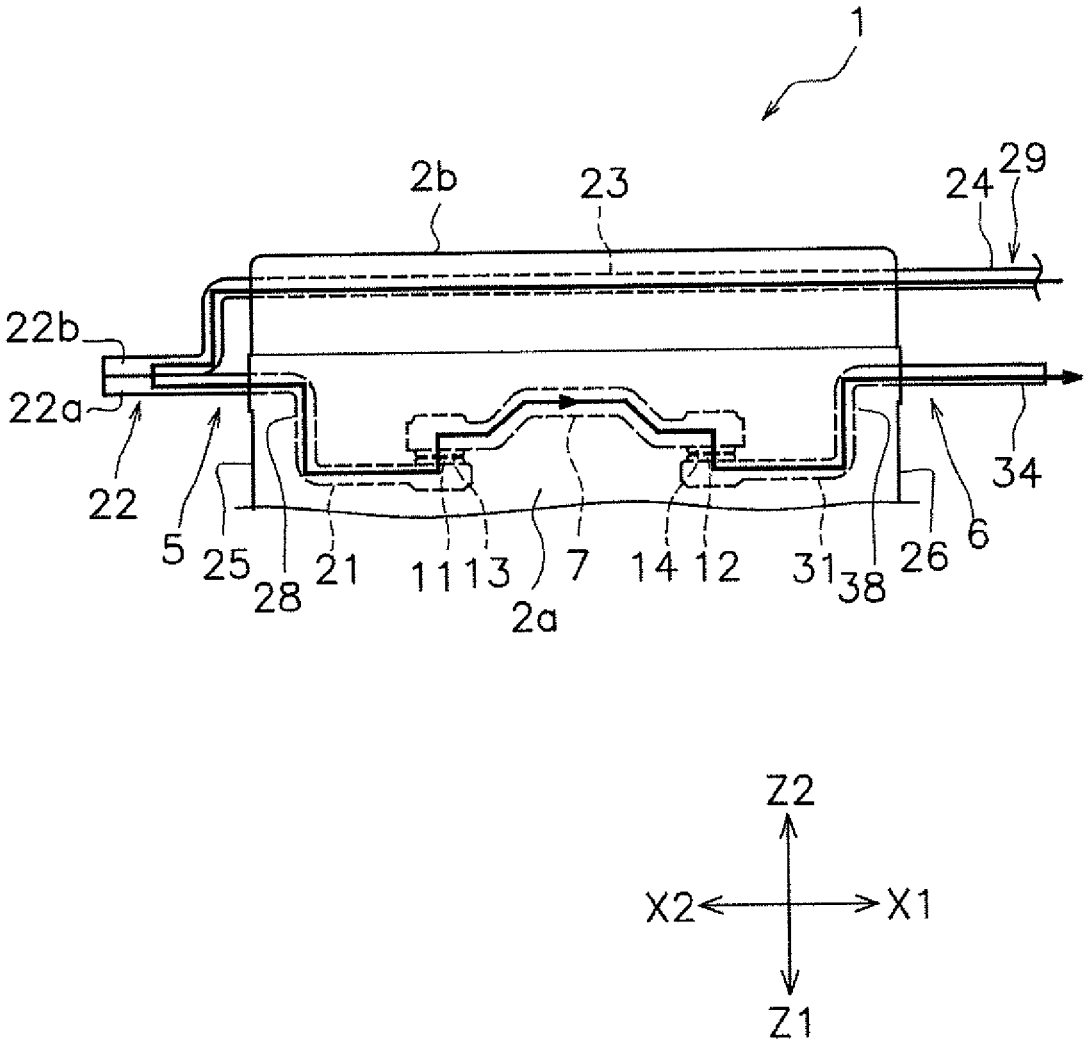
FIG. 8 is a front view illustrating a part of a relay according to a first modified example.

In the above embodiment, the first extension 23 and the second extension 33 are provided. However, the second extension 33 may be omitted. That is, in the second fixed terminal 6, the second bus bar 39 described above may be omitted. FIG. 8 is a front view illustrating a part of the relay 1 according to a first modified example. As illustrated in FIG. 8, the second fixed touch piece 38 of the second fixed terminal 6 may include the second contact support 31 and the second external connection 34.

Figure 9:
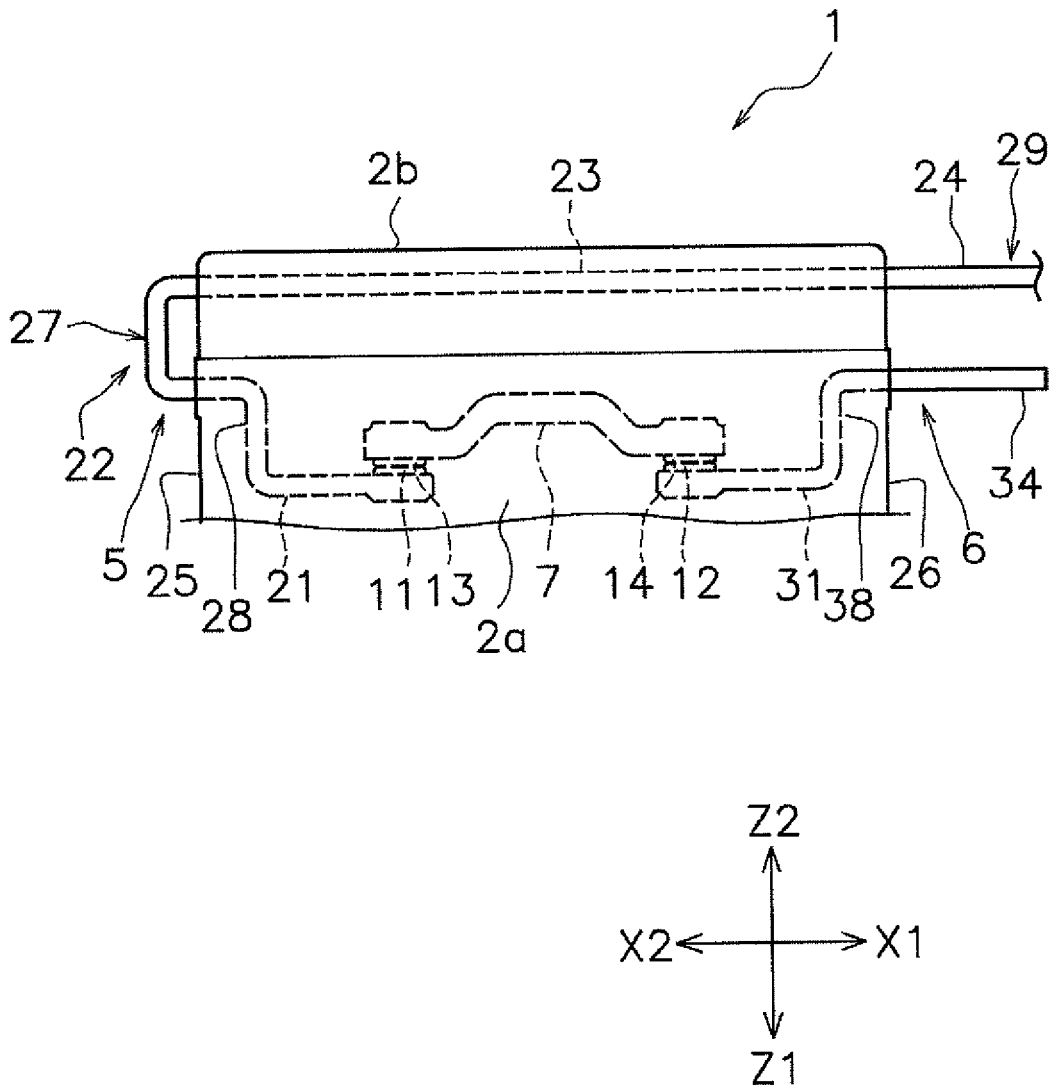
FIG. 9 is a front view illustrating a part of a relay according to a second modified example.
Figure 10:
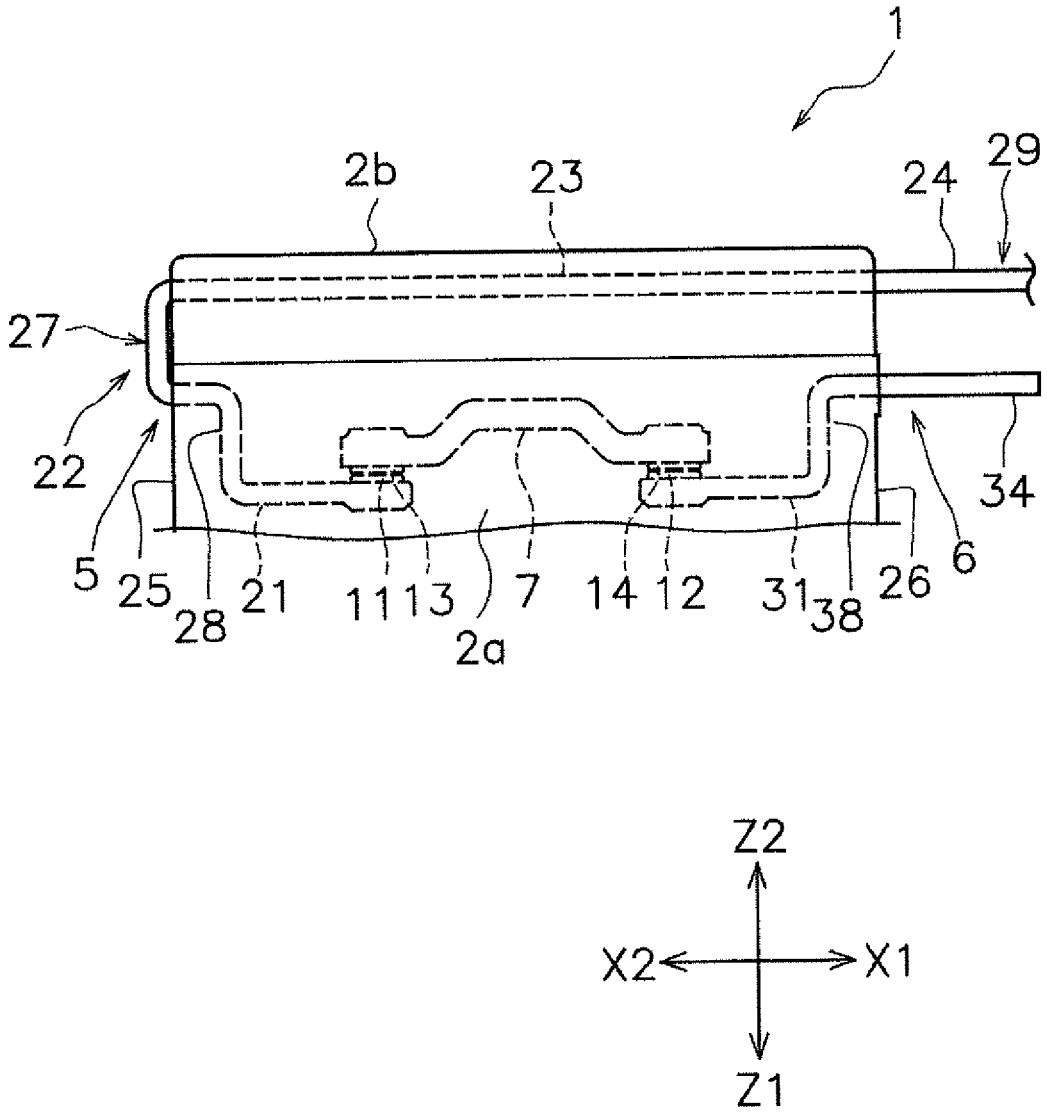
FIG. 10 is a front view illustrating a part of a relay according to a third modified example.

The shape of the first intermediate portion 22 or the second intermediate portion 32 may be changed. FIG. 9 is a front view illustrating a part of the relay 1 according to a second modified example. As illustrated in FIG. 9, the first flat surface 27 may extend in the movement direction (Z1, Z2) of the movable touch piece 7. Alternatively, FIG. 10 is a front view illustrating a part of the relay 1 according to a third modified example. As illustrated in FIG. 10, the first flat surface 27 may be disposed along the first outer side surface 25.

Figure 11:
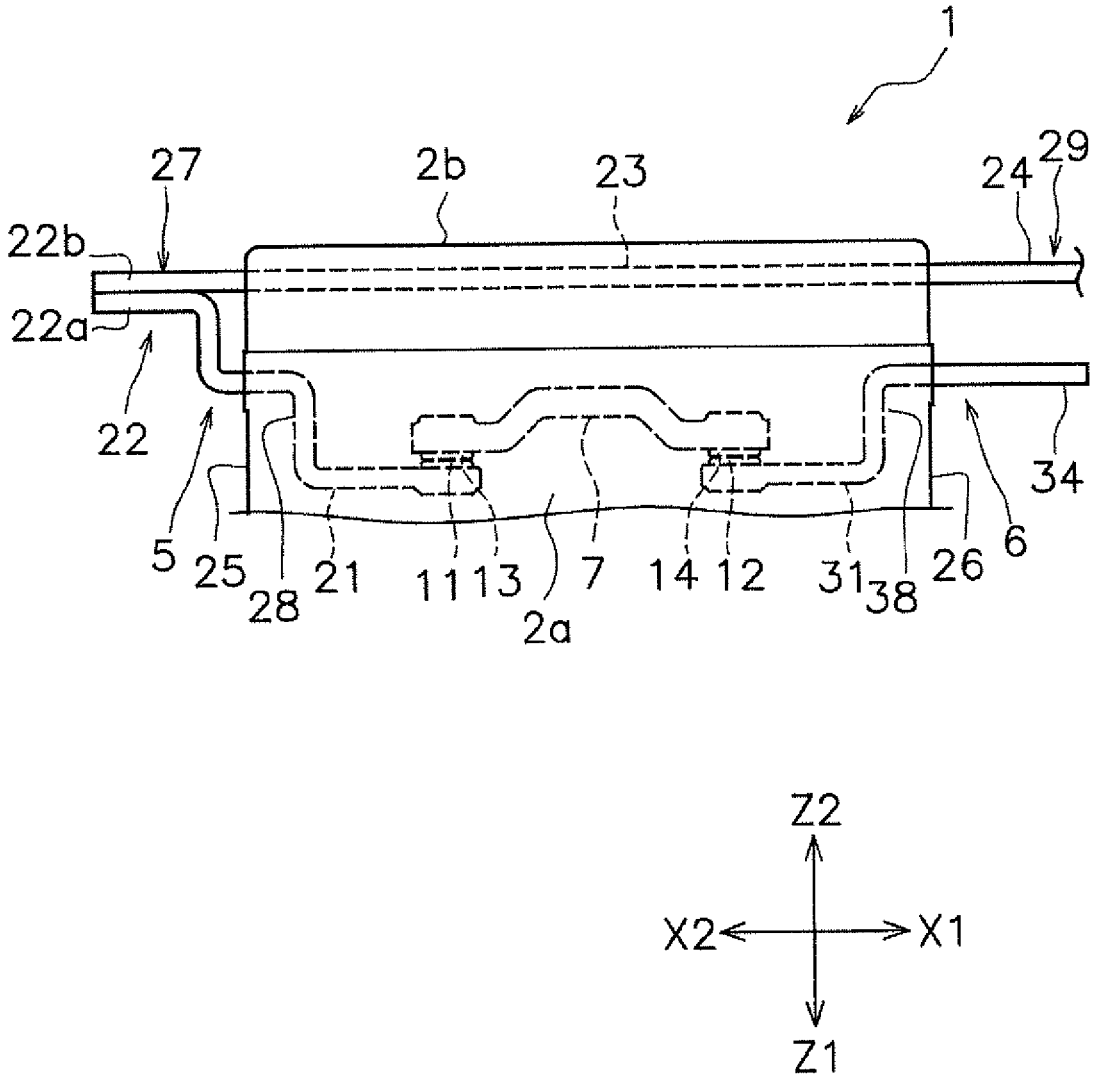
FIG. 11 is a front view illustrating a part of a relay according to a fourth modified example.
Figure 12:
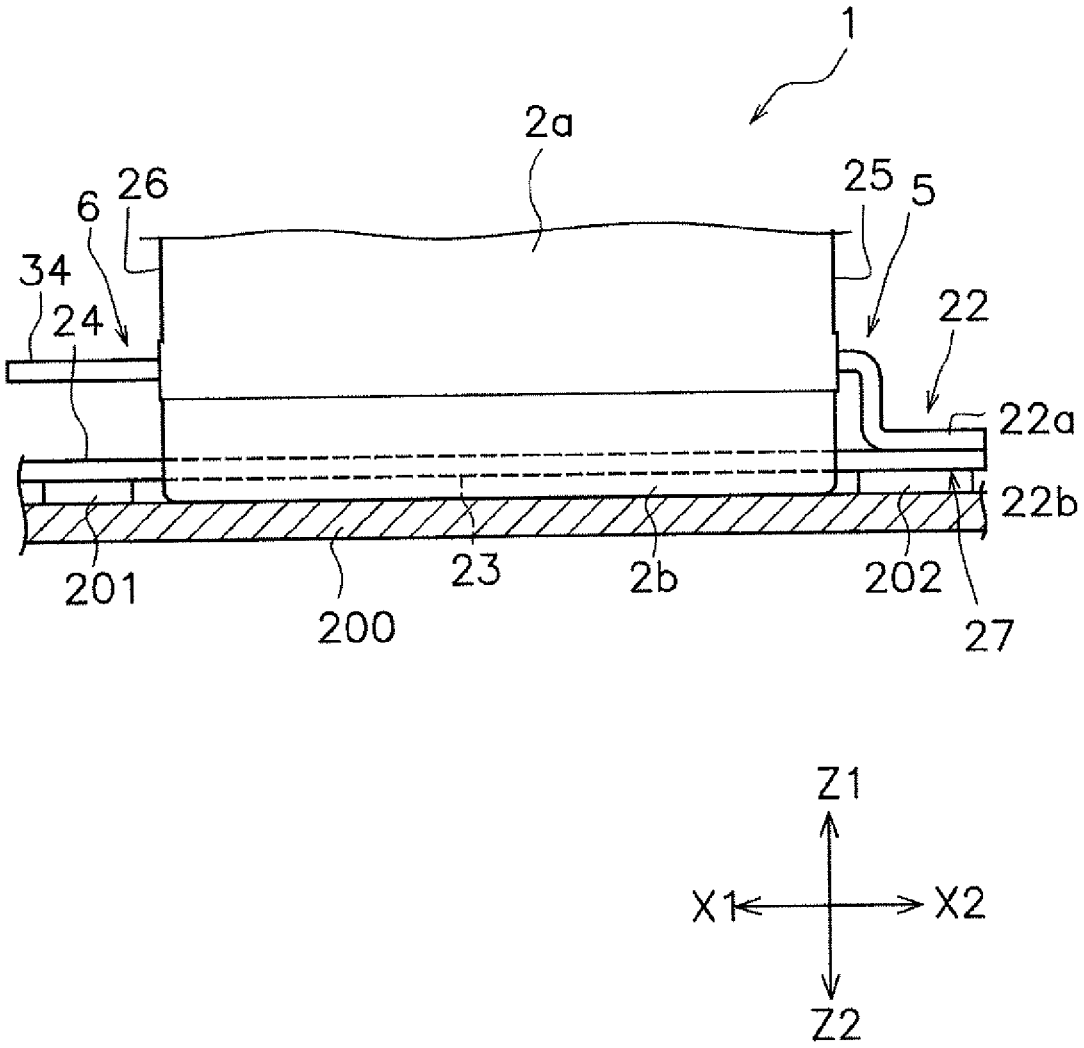
FIG. 12 is a view illustrating an attachment example of a relay according to the fourth modified example.

FIG. 11 is a front view illustrating a part of the relay 1 according to a fourth modified example. As illustrated in FIG. 11, the first flat surface 27 may be disposed to be flush with the first external connection 24. In this instance, as illustrated in FIG. 12, the first flat surface 27 and the first external connection 24 can be disposed at the same height as the bus bar 201 and the cooling body 202 provided on the substrate 200 of the external circuit. Hence it is possible to increase the ease of attachment of the relay 1 to the substrate 200 of the external circuit.

Figure 13:
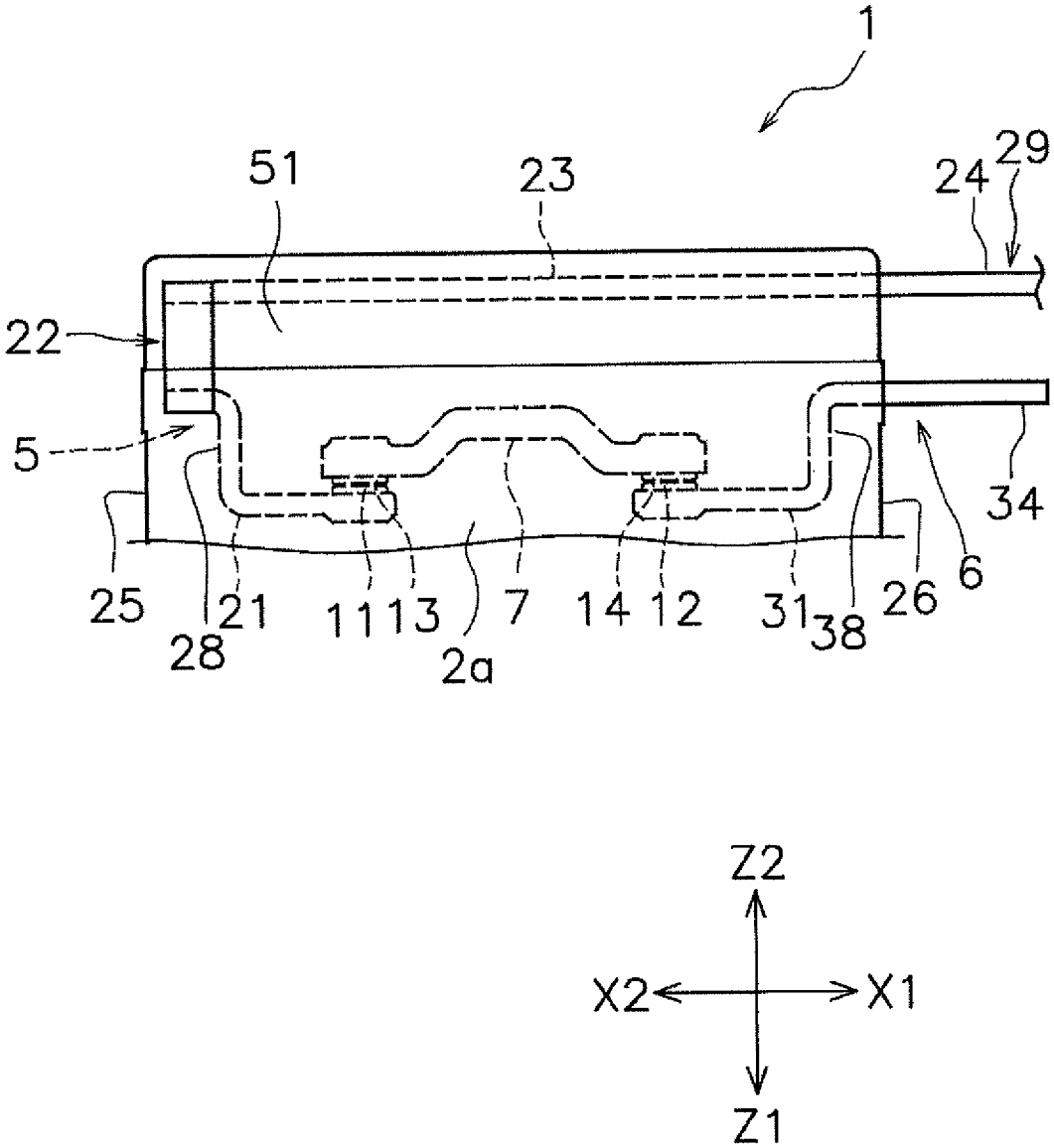
FIG. 13 is a front view illustrating a part of a relay according to a fifth modified example.

The first intermediate portion 22 may be disposed so as to be exposed to the outside from another portion different from the first outer side surface 25 in the case 2. FIG. 13 is a front view illustrating a part of the relay 1 according to a fifth modified example. As illustrated in FIG. 13, the case 2 includes a third outer side surface 51. The third outer side surface 51 connects the first outer side surface 25 and the second outer side surface 26. The third outer side surface 51 is disposed along the first direction (X1) and the second direction (X2). The first intermediate portion 22 may be disposed so as to be exposed to the outside from the third outer side surface 51 in the case 2. In this instance, the first flat surface 27 of the first intermediate portion 22, described above, may extend from the third outer side surface 51 in a direction intersecting the third outer side surface 51. Alternatively, the first flat surface 27 of the first intermediate portion 22 may be disposed along the third outer side surface 51.

Figure 14:
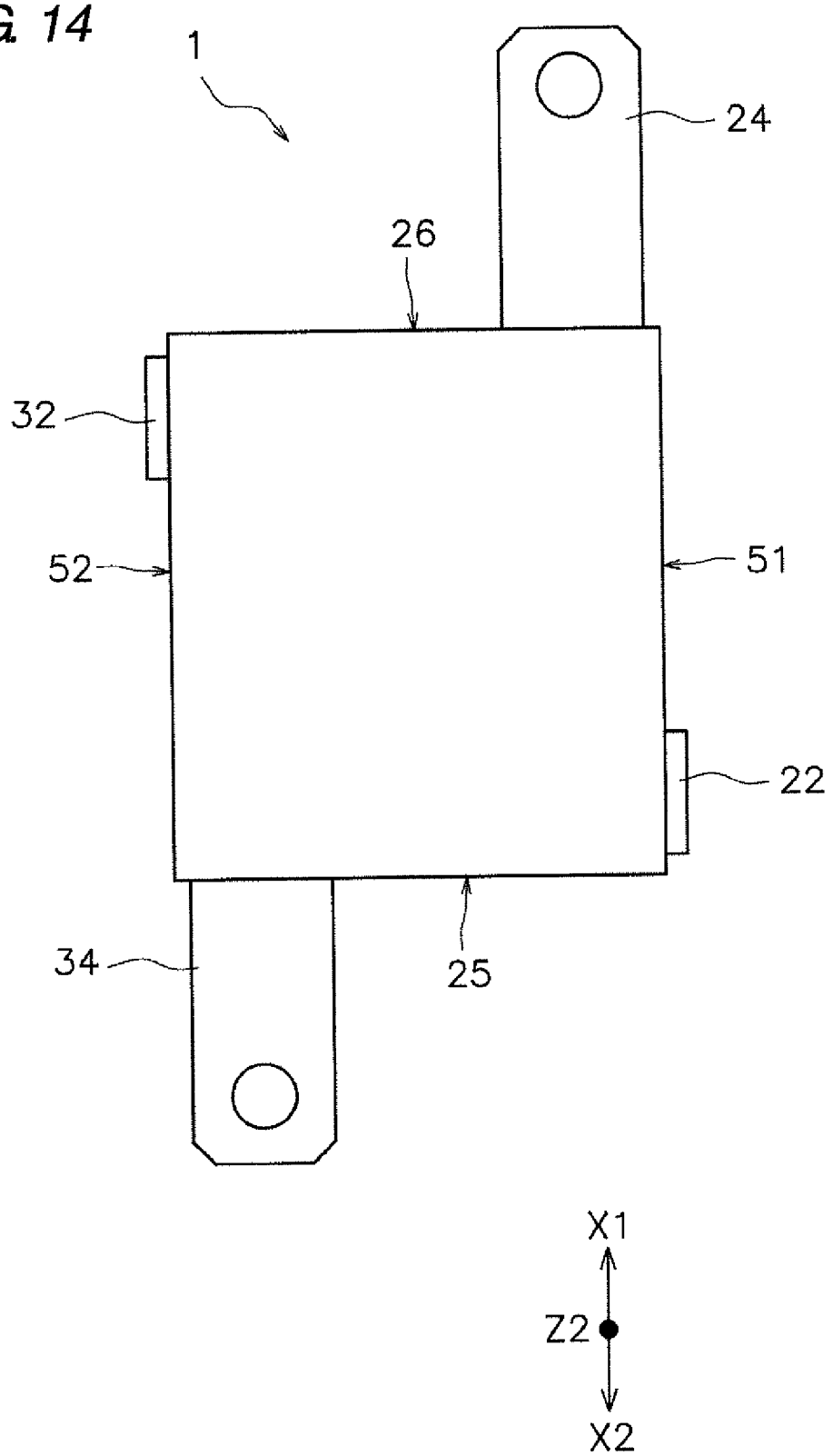
FIG. 14 is a plan view of a relay according to a sixth modified example.

FIG. 14 is a plan view illustrating a part of the relay 1 according to a sixth modified example. As illustrated in FIG. 14, the case 2 includes a fourth outer side surface 52. The fourth outer side surface 52 is disposed on the opposite side of the third outer side surface 51 and connects the first outer side surface 25 and the second outer side surface 26. The fourth outer side surface 52 is disposed along the first direction (X1) and the second direction (X2). The first intermediate portion 22 may be disposed so as to be exposed to the outside from the third outer side surface 51 in the case 2. The second intermediate portion 32 may be disposed so as to be exposed to the outside from the fourth outer side surface 52 in the case 2.

In this instance, the first flat surface 27 of the first intermediate portion 22, described above, may extend from the third outer side surface 51 in a direction intersecting the third outer side surface 51. Alternatively, the first flat surface 27 may be disposed along the third outer side surface 51. The second flat surface 37 of the second intermediate portion 32 may extend from the fourth outer side surface 52 in a direction intersecting the fourth outer side surface 52. Alternatively, the second flat surface 37 may be disposed along the fourth outer side surface 52.

Figure 15:
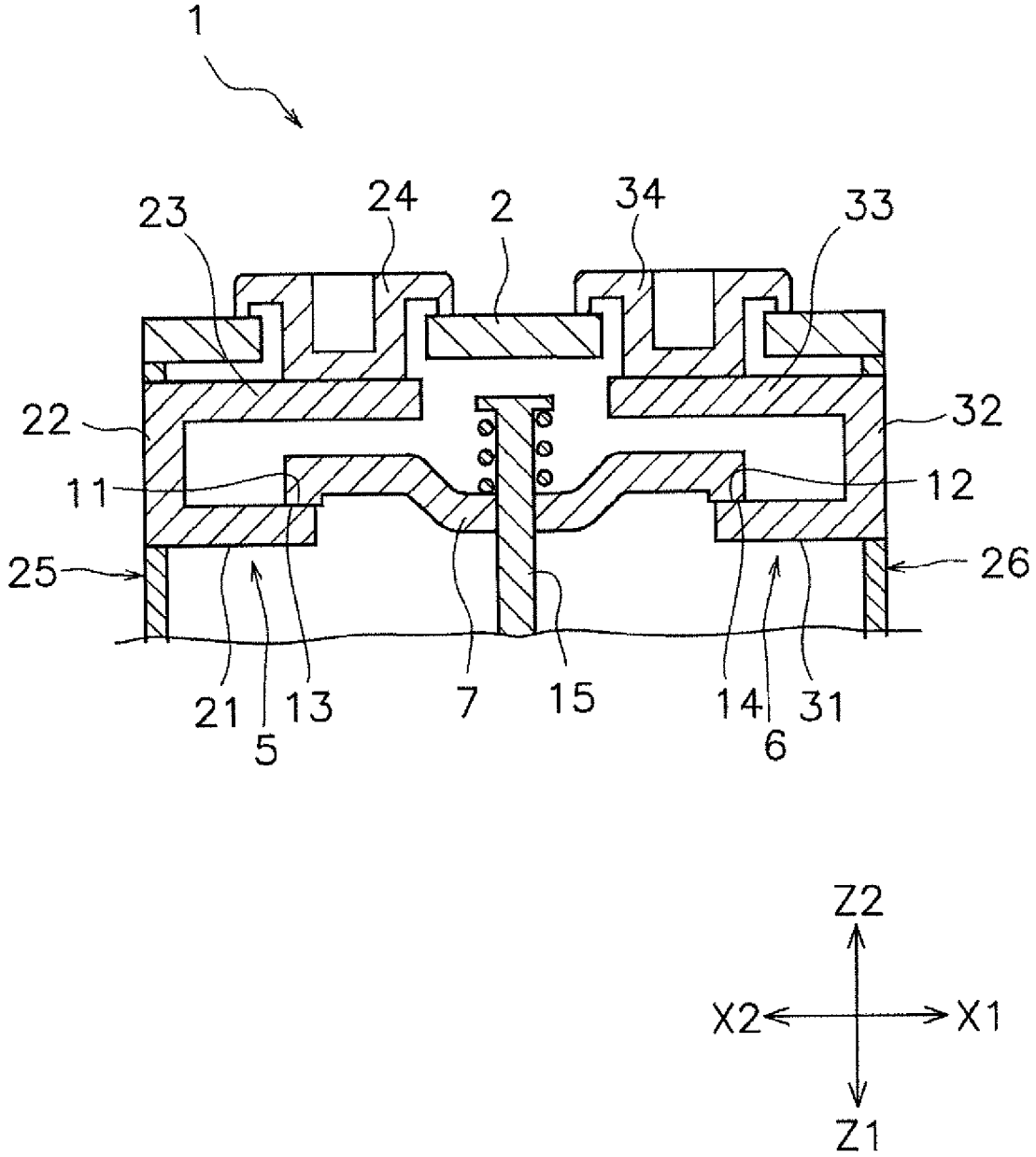
FIG. 15 is a sectional view illustrating a part of a relay according to a seventh modified example.

FIG. 15 is a sectional view illustrating a part of the relay 1 according to a seventh modified example. As illustrated in FIG. 15, the first external connection 24 may be a terminal separate from the first extension 23. The first contact support, the first intermediate portion 22, and the first extension 23 may be formed integrally. The second external connection may be a terminal separate from the second extension 33. The second contact support 31, the second intermediate portion 32, and the second extension 33 may be formed integrally.

Figure 16:
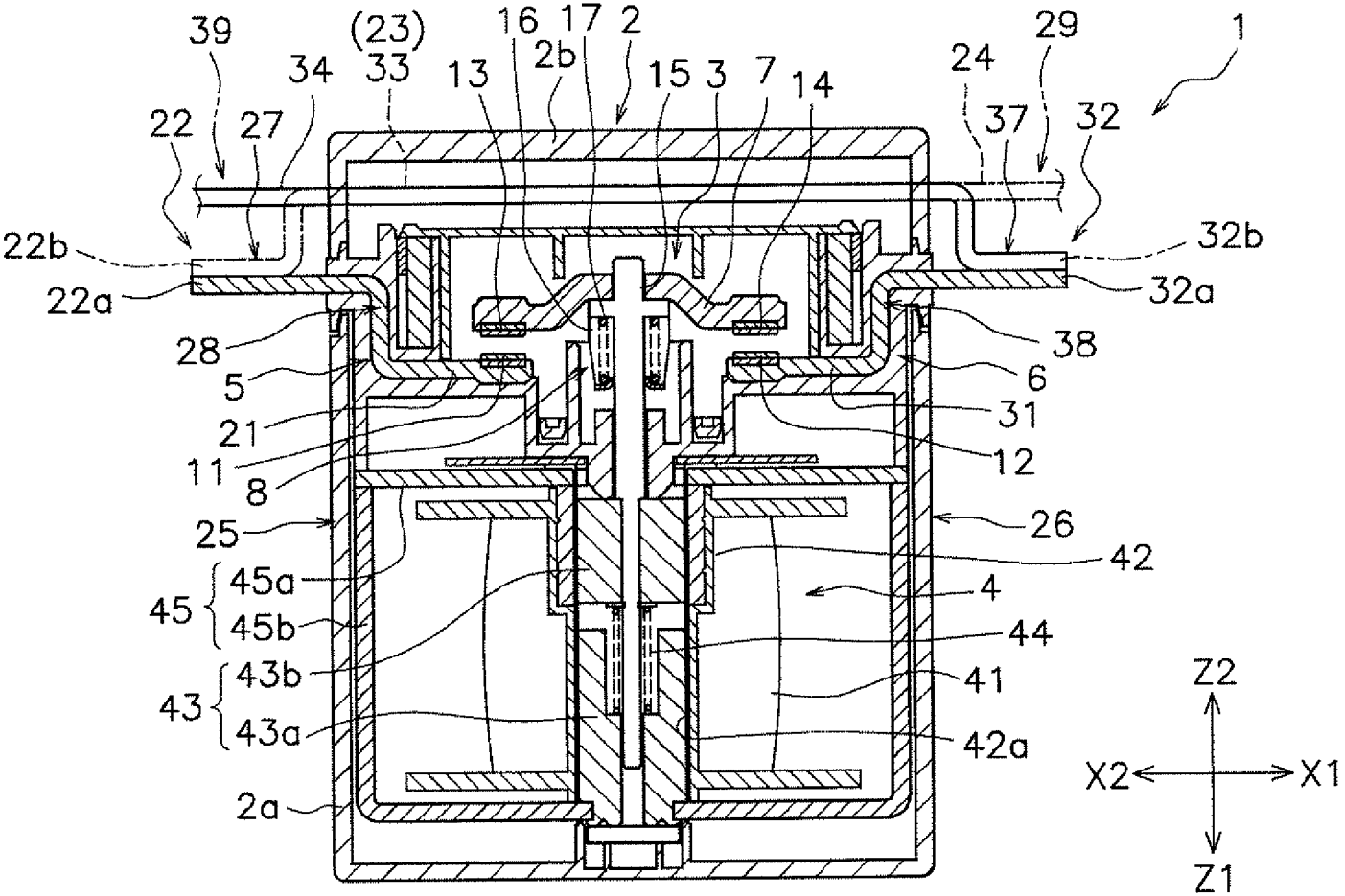
FIG. 16 is a sectional view of a relay according to an eighth modified example.

In the above embodiment, the first extension 23 and the second extension 33 are embedded in the lid portion 2*b* of the case 2. However, the first extension 23 and the second extension 33 may be embedded in other portions of the case 2. Alternatively, FIG. 16 is a sectional view of the relay 1 according to an eighth modified example. As illustrated in FIG. 16, the first extension 23 and the second extension 33 may be disposed in the housing space inside the case 2.

According to one or more embodiments of the present invention, it is possible to improve the cooling efficiency of contacts in a relay.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A relay comprising:

a case;

a first fixed terminal including a first fixed contact;

a second fixed terminal including a second fixed contact;

a movable touch piece including a first movable contact that is disposed facing the first fixed contact and a second movable contact that is disposed facing the second fixed contact, the movable touch piece being disposed in the case and disposed so as to be movable in a direction in which the first movable contact and the second movable contact come into contact with the first fixed contact and the second fixed contact and in a direction in which the first movable contact and the second movable contact separate from the first fixed contact and the second fixed contact, wherein the first fixed terminal includes:

a first contact support disposed in the case and configured to support the first fixed contact, a first extension disposed in the case and extending in a first direction from the first movable contact to the second movable contact, a first external connection connected to the first extension and disposed outside the case, and a first intermediate portion connecting the first contact support and the first extension and having a shape folded back from the first contact support to the first extension, and wherein at least a part of the first intermediate portion is exposed to an outside of the case.

2. The relay according to claim 1, wherein the first intermediate portion includes a first flat surface, and wherein the first flat surface is disposed so as to be exposed to the outside of the case.

3. The relay according to claim 2, wherein the first flat surface extends from an outer side surface of the case in a direction intersecting the outer side surface.

4. The relay according to claim 3, wherein the first flat surface is disposed to be flush with the external connection.

5. The relay according to claim 2, wherein the first intermediate portion is exposed to the outside from the outer side surface of the case, and wherein the first flat surface is disposed along the outer side surface.

6. The relay according to claim 1, wherein the first fixed terminal includes:

a first fixed touch piece including the first contact support, and a first bus bar including the first extension and being separate from the first fixed touch piece, wherein the first intermediate portion includes:

a first attachment portion formed integrally with the fixed touch piece, and a second attachment portion formed integrally with the first bus bar and attached to the first attachment portion, and wherein the first attachment portion and the second attachment portion are disposed so as to be exposed to the outside of the case.

7. The relay according claim 1, wherein the first extension extends to a position beyond the first fixed contact in the first direction.

8. The relay according to claim 1, wherein the first extension extends to a position beyond the second fixed contact in the first direction.

9. The relay according to claim 1, wherein the first extension is embedded in the case.

10. The relay according to claim 1, wherein the first extension is disposed in a housing space in the case.

11. The relay according to claim 1, wherein the second fixed terminal includes a second contact support disposed in the case and configured to support the second fixed contact, a second extension disposed in the case and extending in a second direction from the second movable contact to the first movable contact, a second external connection connected to the second extension and disposed outside the case, and a second intermediate portion having a shape folded back from the second contact support to the second extension, and wherein at least a part of the second intermediate portion is disposed to be exposed to the outside of the case.

12. The relay according to claim 11, wherein the first intermediate portion includes a first flat surface disposed so as to be exposed to the outside of the case, wherein the second intermediate portion includes a second flat surface disposed so as to be exposed to the outside of the case, and wherein the first flat surface and the second flat surface are positioned at the same height.

13. The relay according to claim 11, wherein the first intermediate portion includes the first flat surface disposed so as to be exposed to the outside of the case, wherein the second intermediate portion includes the second flat surface disposed so as to be exposed to the outside of the case, and wherein the first flat surface and the second flat surface are disposed to be flush with each other.

14. The relay according to claim 2, wherein the first fixed terminal includes:

a first fixed touch piece including the first contact support, and a first bus bar including the first extension and being separate from the first fixed touch piece, wherein the first intermediate portion includes:

a first attachment portion formed integrally with the fixed touch piece, and a second attachment portion formed integrally with the first bus bar and attached to the first attachment portion, and wherein the first attachment portion and the second attachment portion are disposed so as to be exposed to the outside of the case.

15. The relay according to claim 3, wherein the first fixed terminal includes:

a first fixed touch piece including the first contact support, and a first bus bar including the first extension and being separate from the first fixed touch piece, wherein the first intermediate portion includes:

a first attachment portion formed integrally with the fixed touch piece, and a second attachment portion formed integrally with the first bus bar and attached to the first attachment portion, and wherein the first attachment portion and the second attachment portion are disposed so as to be exposed to the outside of the case.

16. The relay according to claim 4, wherein the first fixed terminal includes:

a first fixed touch piece including the first contact support, and a first bus bar including the first extension and being separate from the first fixed touch piece, wherein the first intermediate portion includes:

a first attachment portion formed integrally with the fixed touch piece, and a second attachment portion formed integrally with the first bus bar and attached to the first attachment portion, and wherein the first attachment portion and the second attachment portion are disposed so as to be exposed to the outside of the case.

17. The relay according to claim 5, wherein the first fixed terminal includes:

a first fixed touch piece including the first contact support, and a first bus bar including the first extension and being separate from the first fixed touch piece, wherein the first intermediate portion includes:

a first attachment portion formed integrally with the fixed touch piece, and a second attachment portion formed integrally with the first bus bar and attached to the first attachment portion, and wherein the first attachment portion and the second attachment portion are disposed so as to be exposed to the outside of the case.

18. The relay according claim 2, wherein the first extension extends to a position beyond the first fixed contact in the first direction.

19. The relay according claim 3, wherein the first extension extends to a position beyond the first fixed contact in the first direction.

20. The relay according claim 4, wherein the first extension extends to a position beyond the first fixed contact in the first direction.

* * * * *